US005467259A

United States Patent [19]

Hume et al.

[11] Patent Number: 5,467,259

[45] Date of Patent: Nov. 14, 1995

[54] DECORATIVE LAMP

[75] Inventors: Roger A. Hume; Richard A. Felstead, both of Melton Mowbray, England

[73] Assignee: GE Lighting Limited, United Kingdom

[21] Appl. No.: 938,144

[22] PCT Filed: Apr. 29, 1991

[86] PCT No.: PCT/GB91/00678

§ 371 Date: Dec. 2, 1992

§ 102(e) Date: Dec. 2, 1992

[87] PCT Pub. No.: WO91/17387

PCT Pub. Date: Nov. 14, 1991

[30] Foreign Application Priority Data

May 1, 1990 [GB] United Kingdom ..... 9009754

[51] Int. Cl.[6] ..... F21V 3/02

[52] U.S. Cl. ..... 362/307; 362/329; 362/311

[58] Field of Search ..... 362/267, 307, 362/311, 328, 329, 331, 356, 363

[56] References Cited

U.S. PATENT DOCUMENTS

| | | | |
|---|---|---|---|
| 2,802,097 | 8/1957 | Franck | 362/331 |
| 3,483,365 | 12/1969 | Starr | 362/328 |
| 4,323,956 | 4/1982 | Pustka | 362/267 |
| 4,914,342 | 4/1990 | Mujahid et al. | 362/307 |

FOREIGN PATENT DOCUMENTS

| | | | |
|---|---|---|---|
| 652086 | 11/1962 | Canada | 362/311 |
| 447689 | 1/1913 | France . | |
| 314226 | 6/1929 | United Kingdom | 362/267 |

*Primary Examiner*—Ira S. Lazarus
*Assistant Examiner*—Sara Raab
*Attorney, Agent, or Firm*—Pollock, Vande Sande & Priddy

[57] ABSTRACT

A low voltage reflector lamp comprises a bowl-shaped reflector symmetrically disposed about an optical axis, and a low voltage light source permanently located within the reflector at a predetermined position. A transparent or translucent decorative appendage is located at the outer edge of the annular rim of the reflector, said appendage also having a rim at an annular edge of complementary size to that of said first annular rim. Annular fixing means serve to press said rims together to secure said decorative appendage rigidly to said reflector.

3 Claims, 2 Drawing Sheets

DECORATIVE LAMP

The present invention relates to lamps, and in particular to low voltage reflector lamps.

Low voltage reflector lamps are employed in applications such as display lighting where a low power consumption, long lamp-life and an acceptable thermal performance are required.

Known low voltage reflector lamps are available wherein the reflector is designed to direct light precisely, permitting highlighting and profiling and a well controlled beam of light in addition to producing a pleasing environment.

Such lamps may be manufactured to incorporate a curved or flat glass front which serves as a protective feature. It protects the bulb and reflector surface from harsh environments. Such lamps are produced by GE Thorn Lamps Limited.

In addition, it is possible to obtain attachments for such lamps which serve as a decorative appendage. However, such attachments, as provided by GE Thorn Lamps limited, require a special adaptor such that the decorative attachment may easily be added to a fitting in which the existing lamp is located. In order to install such a lamp the relatively expensive adaptor must necessarily be purchased in addition to the lamp unit.

SUMMARY OF THE INVENTION

An object of the invention is to provide a unitary lamp assembly incorporating a decorative appendage.

According to the invention there is provided a low voltage reflector lamp comprising a bowl-shaped reflector symmetrically disposed about an optical axis and having an annular rim, a low voltage light source permanently located within the reflector at a predetermined position, and a transparent or translucent appendage located at the annular rim, characterised in that the said appendage has a rim at an annular edge of complementary size to that of the annular rim of the reflector, and in that an annular fixing means having two inwardly directed flanges is provided, which flanges axially engage the rims of said reflector and said appendage and which by being pressed or rolled hold said rims together to secure said appendage rigidly and permanently to said reflector.

The reflector and decorative appendage may be formed separately and permanently joined after location of the light source. Should the lamp require replacement, the entire lamp including the decorative appendage may be replaced as a single unit.

The invention will now be described by way of example with reference to the accompanying drawings.

DESCRIPTION OF THE PREFERRED EMBODIMENT

In the arrangement shown in each of the embodiments there comprises a reflector lamp 10 Comprising a bowl-shaped reflector 11 symmetrically disposed about an optical axis, and a light source 12 in the form of a low-voltage tungsten halogen lamp located permanently at a defined position. The bowl is formed with a multi-faceted reflector surface moulded (for example in honeycomb pattern 13 or a rectangular pattern) on the inner surface of the bowl. A reflective coating on the inner surface serves to allow most of the heat to pass backwards through the reflector shell whilst directing the beam forwards.

The exterior surface of the bowl may be plain or preferably slightly crinkled in which case with the reflector 11 being moulded in transparent glass or plastics the facet pattern 13 appears hazy or slightly out of focus to the eye.

Figure 1:
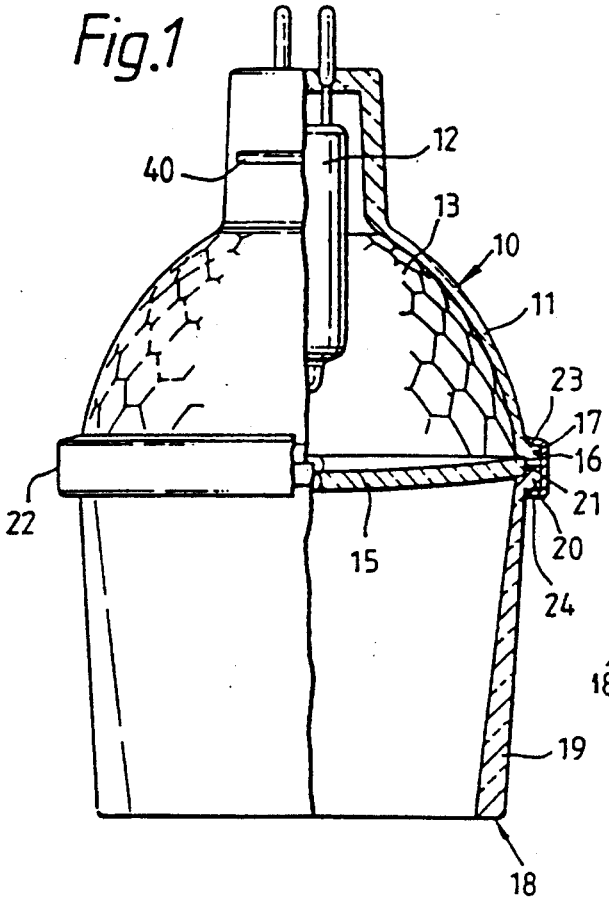
FIG. 1 is a part elevation and part section of a first embodiment of a lamp assembly in accordance with the invention having an open ended tubular appendage narrowing slightly in the direction of the projected beam.
Figure 2:
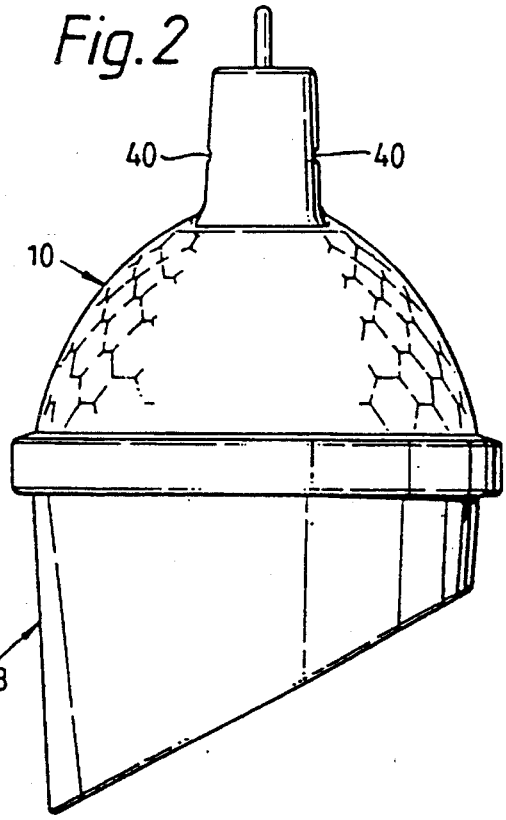
FIG. 2 is an elevation of a second embodiment having a tubular appendage similar to that shown in FIG. 1 modified by an oblique end surface.

In the examples shown in FIGS. 1 and 2 the open end of the reflector 11 is closed by a plain dished lens 15 which seats in a recess 16 formed in a flange 17 provided at the lower edge of the reflector 11. The lens protects the reflective coating and also prevents injury in the event of lamp breakage.

A decorative appendage 18 comprises a tube 19 also provided with a flange 20 at a rim at its upper end; a recess 21 in said flange 20 accommodating the lens 15.

The unitary assembly comprising the lamp assembly 10, lens 15 and appendage 18, are secured together by attaching means in the form of a ring 22, having inwardly facing flanges 23, 24, effecting permanent connection of the components by deformation of the ring by rolling or stamping.

The appendage shown in the FIG. 2 example differs from FIG. 1 only by the obliquely truncated end.

In such units, the appendage and lamp would be produced as separate units and combined via the use of the sealing ring, for example, so that the entire unit is sealed together.

Figure 3:
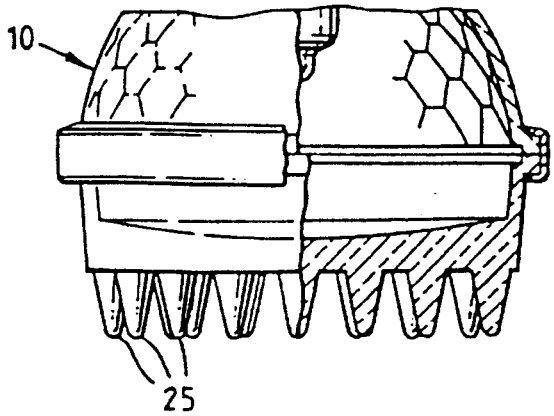
FIGS. 3, 4 and 5 show further embodiments in which the various appendages are closed at their lower ends.
Figure 4:
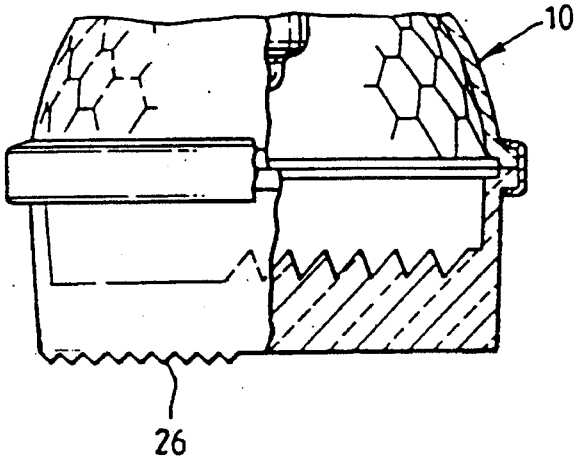
Figure 5:
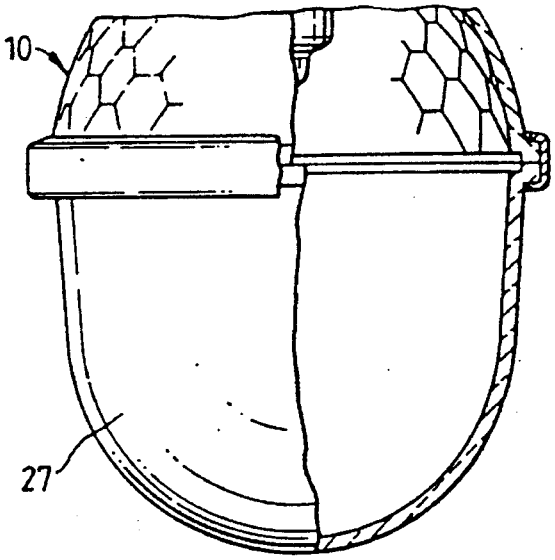

The examples shown in FIGS. 3, 4 and 5 show decorative appendages which are entirely enclosed constructions comprising respectively a cap having axially extending cones 25, a cap having parallel prisms 26 formed on the end surface, and a dome 27. In the case of the enclosed constructions the dished lens is omitted.

Figure 6:
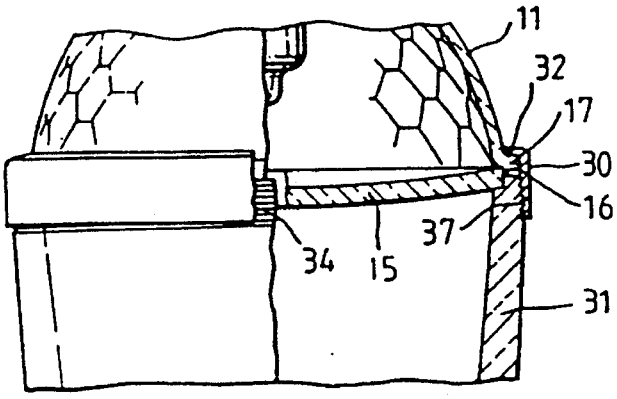
FIG. 6 shows in part elevation and part section an alternative construction for attachment of the appendage in the lamp assembly.

In FIG. 6 the ring 30 serving to attach the decorative appendage 31 to the reflector 11 has only one flange 32 at the upper end, the lower end having an internal thread 33 by which an external thread 34 on the appendage is attached and enables the latter to secure the lens to the reflector. Any one of the examples shown may have a threaded attachment instead of a flange.

With the arrangement described with reference to FIG. 6 the user may select any decorative appendage available and simply attach the appendage to the lamp without purchasing the alternative fitting.

It is also possible to provide attaching means (see grooves 40) which may be engaged by clips of a holder such as that disclosed in Patent No. 2 153 986 (GE Thorn Lamps Limited, United Kingdom).

The decorative appendage may take many forms, for example, hollow cylinders, domes, cones and multiple pyramids. The appendages may be opaque, clear or coloured. The form selected is dependent upon whether the lamp is to be concealed or simply hidden by the appendage.

The appendage assists in producing a dramatic visual effect by, for example, blending into the adjacent fabric or by protruding from the surface in which the lamp unit is installed.

Providing such a lamp unit with a decorative appendage may alleviate the conventional spot light appearance of known reflector lamps and provide a less obtrusive lighting element, one which would be suitable for any environment including the domestic environment. The units may be utilised in a situation in which the appendage protrudes from the wall or ceiling into which the lamp is installed to contribute to a more striking visual impact and greater awareness. Hence for those who find the 'Studio' look appealing but do not desire the conventional design associated with such lamps and fittings, the present invention provides a solution.

The present invention provides an improved low voltage reflector lamp allowing use of a decorative attachment with an extended range of fittings for conventional low voltage reflector lamps.

We claim:

1. A low voltage reflector lamp comprising:

a bowl-shaped reflector symmetrically disposed about an optical axis and having an annular rim;

a low voltage light source permanently located within the reflector at a predetermined position;

a light-transmitting appendage located at said annular trim, the appendage having a rim at an annular edge of complementary size to that of said annular rim of the reflector; and annular fixing means having two inwardly directed flanges, the flanges axially engaging said rims of the reflector and the appendage and being permanently deformed to hold the rims together to secure the appendage rigidly and permanently to the reflector, said rims having cooperating recesses adapted to seat a transparent cover.

2. The low voltage reflector lamp of claim 1 wherein said light-transmitting appendage is closed at one end.

3. The low voltage reflector of claim 1, wherein said flanges are permanently deformed by pressing or rolling for securing said appendage to said reflector.

* * * * *